US007150282B2

(12) United States Patent
Lane

(10) Patent No.: US 7,150,282 B2
(45) Date of Patent: Dec. 19, 2006

(54) CLOTHESPIN CLIP HAIR ACCESSORY

(75) Inventor: Teresa Lane, Kansas City, MO (US)

(73) Assignee: Celebrity Signatures International, Inc., Kansas City, MO (US)

( * ) Notice: Subject to any disclaimer, the term of this patent is extended or adjusted under 35 U.S.C. 154(b) by 58 days.

(21) Appl. No.: 10/919,647

(22) Filed: Aug. 17, 2004

(65) Prior Publication Data

US 2006/0037626 A1 Feb. 23, 2006

(51) Int. Cl.
*A41G 3/00* (2006.01)

(52) U.S. Cl. ..... 132/201; 132/277

(58) Field of Classification Search ..... 132/276, 132/277, 53, 201; 24/501, 511, 493
See application file for complete search history.

(56) References Cited

U.S. PATENT DOCUMENTS

| | | | | |
|---|---|---|---|---|
| 3,242,564 | A * | 3/1966 | Longhini | 29/434 |
| 3,860,014 | A * | 1/1975 | Clifton | 132/278 |
| 5,501,239 | A * | 3/1996 | Walker | 132/275 |
| 5,813,418 | A | 9/1998 | Pillars | |
| 5,868,145 | A | 2/1999 | Spann | |
| 5,896,865 | A * | 4/1999 | Patel | 132/277 |
| 6,082,371 | A | 7/2000 | Bader-Saltzman et al. | |
| 6,135,125 | A | 10/2000 | Sartena | |
| D433,774 | S | 11/2000 | Diaz | |
| 6,206,011 | B1 | 3/2001 | Sartena | |
| 6,247,476 | B1 | 6/2001 | Sartena | |
| 6,257,250 | B1 | 7/2001 | Sartena | |
| D447,286 | S | 8/2001 | Diaz | |
| 6,273,097 | B1 | 8/2001 | Sartena | |
| 6,302,115 | B1 | 10/2001 | Sartena | |
| 6,510,856 | B1 | 1/2003 | Ahn | |
| 6,513,535 | B1 | 2/2003 | Lane | |
| 6,581,611 | B1 | 6/2003 | Sartena | |
| 6,591,843 | B1 * | 7/2003 | Langohr | 132/277 |
| 6,629,536 | B1 | 10/2003 | Lane | |

* cited by examiner

*Primary Examiner*—Cris L Rodriguez
*Assistant Examiner*—Rachel A. Running
(74) *Attorney, Agent, or Firm*—Lathrop & Gage, LC

(57) ABSTRACT

A hair accessory is described which includes an elongated clip having at least two members, each having at least a user grasping portion, a hair engaging portion, and a transition portion therebetween. The hair engaging portions are configured to be adjacent one another along a longitudinal axis for substantially their entire length. The hair accessory further includes a plurality of hair segments attached to the elongated clip between the user grasping portion and the hair engaging portion. A method for fabricating the hair accessory is also described.

21 Claims, 5 Drawing Sheets

CLOTHESPIN CLIP HAIR ACCESSORY

BACKGROUND OF THE INVENTION

This invention relates generally to hair accessories and, more particularly, to a hair accessory that supplements the natural hair of a user which is attached using a clip.

A person may supplement their natural hair with hair pieces to allow a wider variety of hair styles to be utilized. Additionally, when the person has relatively thin hair, the person can supplement their natural hair to create the impression of a fuller head of hair. At least one known form of such a hair piece supplements the natural hair by attaching strands of hair to a visible hair attachment device. The hair attachment device is then used to hold the hair piece to the person's head. However, at least one known form of such an attachment device has been known to become detached during use, hanging from the person's natural hair or falling off completely. Such persons may wish to supplement their natural hair with a securely attachable hair accessory, with the attachment device remaining substantially unseen or at least providing an ornamental function along with the additional hair strands.

BRIEF SUMMARY OF THE INVENTION

In one aspect, a hair accessory is provided that comprises an elongated clip comprising at least two members. Each member comprises a user grasping portion, a hair engaging portion, and a transition portion therebetween. The hair engaging portions of the members are configured to be adjacent one another along a longitudinal axis for substantially their entire length. The hair accessory further comprises a plurality of hair segments attached to the elongated clip.

In another aspect, a method of fabricating a hair accessory is provided. The hair accessory includes an elongated clip with at least two members each having at least a user grasping portion, a hair engaging portion, and a transition portion therebetween. The hair engaging portions are configured to be adjacent one another along a longitudinal axis for substantially their entire length. The hair accessory also includes a plurality of hair segments, and the method comprises configuring the elongated clip such that a pressure exerted at the user grasping portion of the members causes the hair engaging portion to spread apart, and attaching the plurality of hair segments to the elongated clip between the user grasping portion and the hair engaging portion.

In yet another aspect, a hair accessory is provided that comprises an elongated clip comprising a plurality of members substantially adjacent one another along a longitudinal axis for substantially their entire length. The plurality of members have a first end and a second end, and comprise sides. The plurality of members are configured such that a pressure exerted at the first end of the plurality of members causes the second end of the plurality of members to spread apart. The hair accessory further comprises an attaching member configured to hold respective sides of the plurality of members adjacent to one another, and further configured to cause the second ends of the plurality of members to contact one another. The hair accessory further comprises a plurality of hair segments attached to the elongated clip between the first end and the second end.

DETAILED DESCRIPTION OF THE INVENTION

Figure 1:
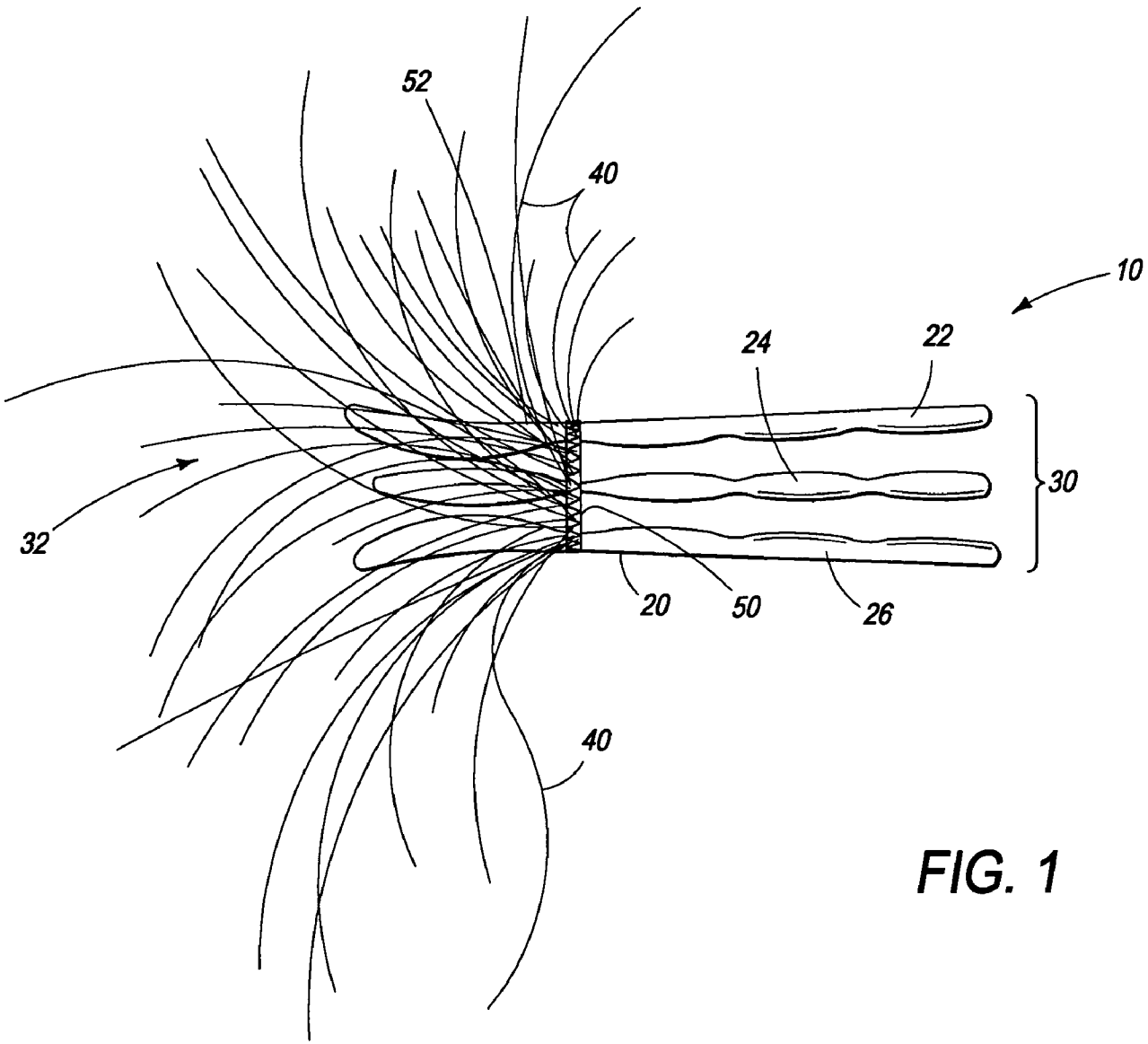
FIG. 1 is a view of one embodiment of a hair accessory which incorporates an elongated clip for attachment of the hair accessory.

FIG. 1 is a view of one embodiment of a hair accessory 10 including an elongated clip 20 having a first member 22, a center member 24, and a second member 26, which are utilized for attaching hair accessory 10 to a user's natural hair (not shown). In one embodiment, as further described below, to attach hair accessory 10 to the user's natural hair, hair engaging portions 30 of elongated clip 20 are spread apart by applying a force to (e.g., squeezing) user grasping portions 32 of elongated clip 20. Then, hair engaging portions 30 are inserted into the user's natural hair and user grasping portions 32 are released allowing hair engaging portions 30 to come back together. As hair engaging portions 30 come back together, they clamp onto the user's hair such that hair accessory 10 stays in place within and on user's hair. To further illustrate, elongated clip 20 operates similarly to a clothespin. As illustrated, and as further described below, hair segments 40 are attached to hair accessory 10. In certain embodiments, hair segments 40 are grouped together in bundles for attachment to hair accessory 10. In addition, and as further described below, hair segments 40 and hair bundles are attached to elongated clip 20 utilizing a hair attachment member 50.

First member 22, center member 24, and second member 26, in the embodiments illustrated, have the same general elongated shape in one plane. More specifically, first member 22, center member 24, and second member 26 have an arc shape which originates at user grasping portions 32 and extends to a transition portion 52 of elongated clip 20. From transition portion 52 to hair engaging portions 30, first member 22, center member 24, and second member 26 are substantially straight, and substantially parallel with one another. The above described embodiment for first member 22, center member 24, and second member 26 is further illustrated with respect to FIG. 4. While described as substantially straight, and substantially parallel to one another, it should be noted that in a particular embodiment, first member 22, center member 24, and second member 26 have a slight taper from transition portion 52 to hair engaging portions 30.

To use hair accessory 10, user grasping portions 32 of elongated clip 20 are squeezed together thus spreading apart hair engaging portions 30 which are then inserted into the user's natural hair at a desired position on the user's head according to individual comfort and style. Upon release of user grasping portions 32, hair engaging portions 30 tend to move back towards one another, clamping onto the user's natural hair. Then hair accessory 10 is blended with the user's hair by pulling the user's natural hair above and around elongated clip 20, until the desired look and style is achieved, which may at least partially conceal elongated clip 20.

Figure 2:
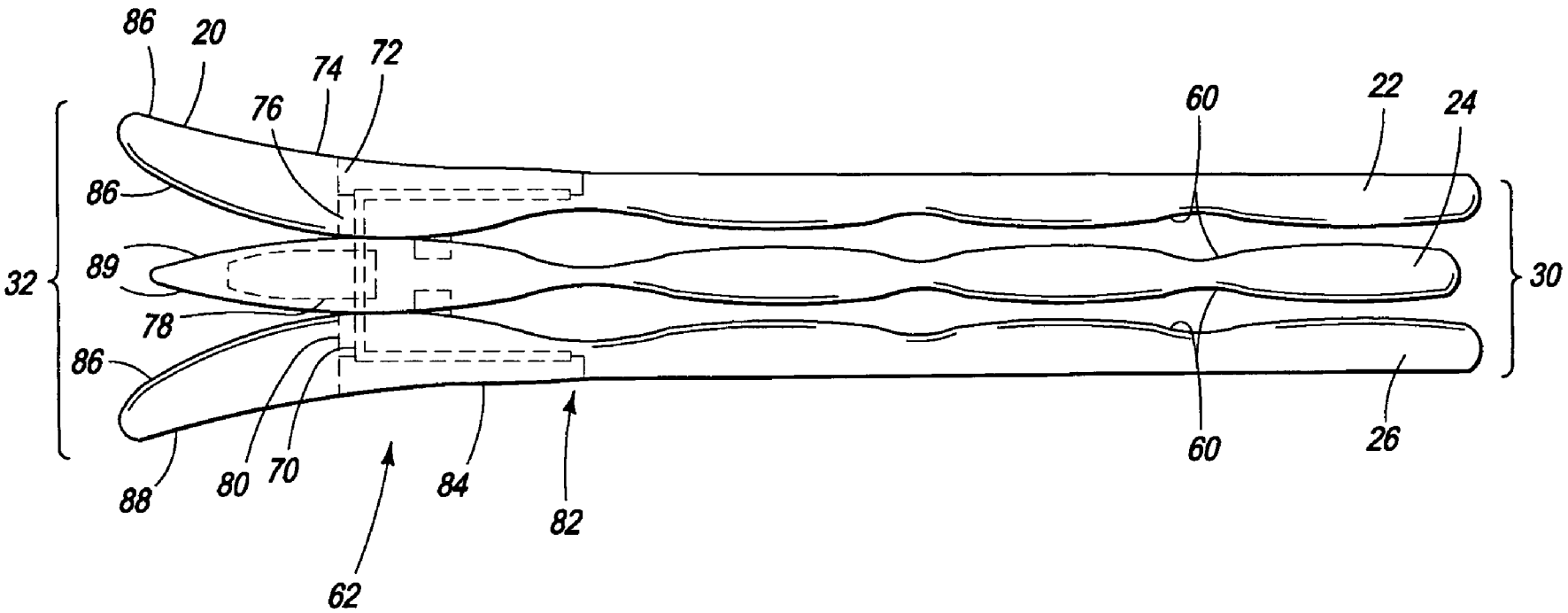
FIG. 2 is a top view of the elongated clip utilized in the hair accessory of FIG. 1.

FIG. 2 is a top view of elongated clip 20. As shown, each of first member 22, center member 24, and second member 26 are formed with undulating surfaces 60. More specifically, an undulating surface 60 of first member 22 is adjacent to an undulating surface 60 of center member 24 and an undulating surface 60 of second member 26 is adjacent to a second undulating surface 60 of center member 24. The adjacent undulating surfaces 60 provide adjacent surfaces to grip a user's hair while allowing at least a portion of the user's hair to pass through, which provides a more natural look. First member 22 and second member 26, at user grasping portion 32 diverge slightly from center member 24, and therefore are not adjacent at user grasping portion 32. The result is a lever point 62 which allows hair engaging portions 30 of first member 22 and second member 26 to spread apart for insertion into a user's hair when a correctly directed force is applied to user grasping portions 32 of first member 22 and second member 26. In other words, squeezing user grasping portions 32 together causes hair engaging portions 30 to spread apart. In alternative embodiments, elongated clip 20 is fabricated from various woods, metals and plastics.

First member 22, center member 24, and second member 26 of elongated clip 20 are held together with a U-shaped attaching member 70 which extends from a slot 72 formed in a side 74 of first member 22 and turns to pass through a hole 76 formed in first member 22. U-shaped attaching member 70 continues to extend through a slot 78 formed in user grasping portion 32 of center member 24 and through a hole 80 formed in second member 26. U-shaped attaching member 70 then turns to extend into slot 82 formed in a side of second member 26. In one embodiment, slot 78 is formed with a detent (not shown) which provides for a snap fit of U-shaped attaching member 70 within slot 78. U-shaped attaching member 70 is formed from a material having flexibility and spring-like features, which allows elongated clip 20 to reassume the configuration shown once a user has released their grip on user grasping portions 32 of first member 22 and second member 26. More specifically, U-shaped attaching member 70 exerts a force which causes hair engaging portions 30 of first member 22, center member 24, and second member 26 of elongated clip 20 to move towards one another until they are adjacent, contacting one another, or until other forces, such as hair between first member 22, center member 24, and second member 26, prevents such contact.

To further maintain alignment and position of first member 22, center member 24, and second member 26 with respect to one another, in one embodiment, first member 22 and second member 26 each include a protrusion 28 formed thereon which fits within a small slot 29 formed in center member 24. Protrusions 28 and small slots 29 are located within the perimeter of U-shaped attaching member 70 to increase effectiveness of U-shaped attaching member 70.

To further describe operation of elongated clip 20, user grasping portions 32 of first member 22 and second member 26 have an arcuate surface 86 which diverges from contact with center member 24. The action of a user applying a pressure to grasping surface 88, along with the above described retention and spring-like qualities of U-shaped attaching member 70, causes a contact point of arcuate surface 86 to "roll" along member engaging surface 89 of center member 24. As pressure to grasping surface 88 is removed, the contact point of arcuate surface 86 "rolls" back along member engaging surface 89 of center member 24 to an original position (assuming that no hair has been inserted into hair engaging portions 30, thereby not allowing elongated clip 20 to assume its original configuration. It should be noted that the above described operation of user grasping portions 32, results in hair engaging portions 30 of first member 22 and second member 26 separating from hair engaging portion 30 of center member 24 in a motion that is best characterized as a slight arc.

Figure 3:
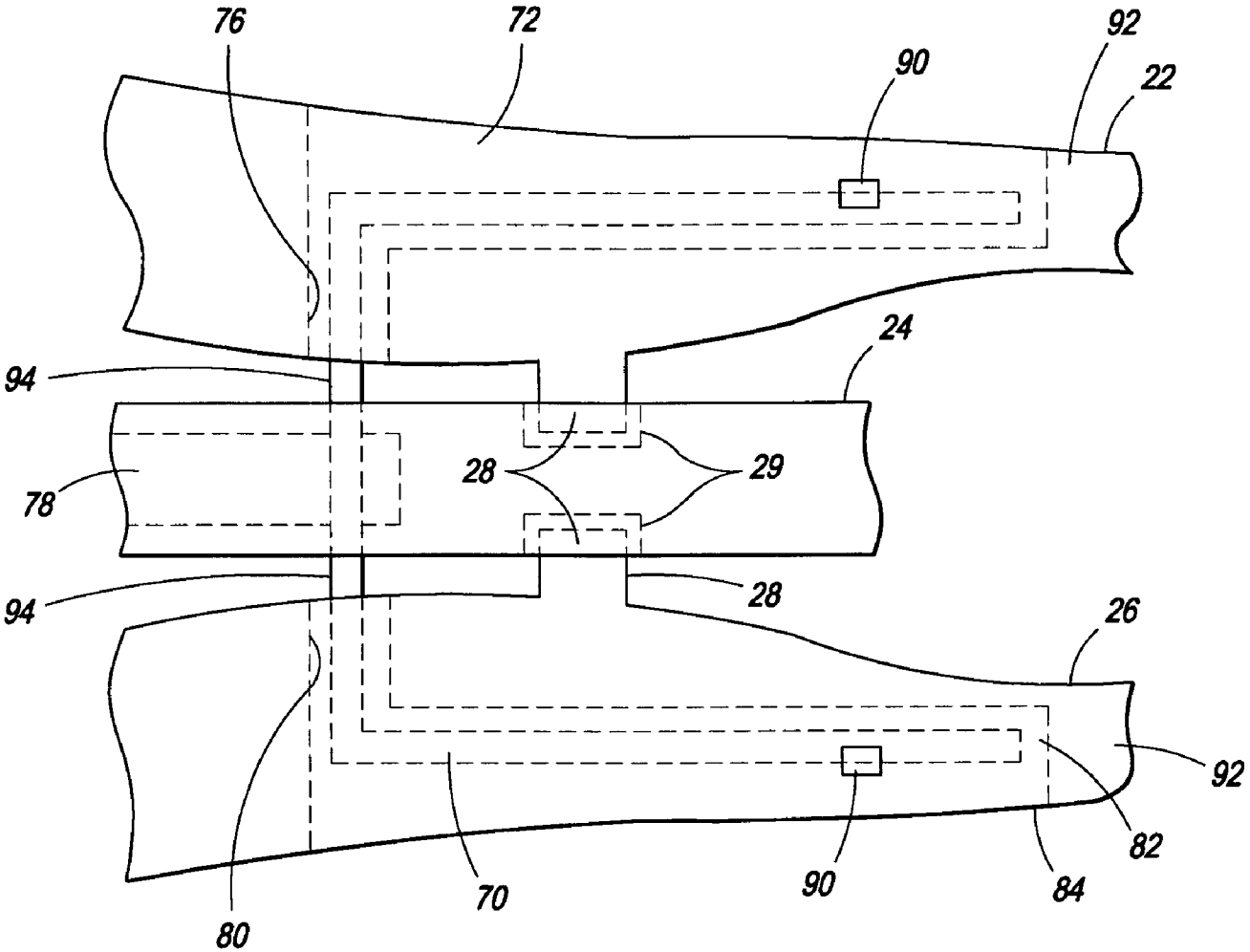
FIG. 3 is a top detail partial view of the elongated clip of FIG. 2.

FIG. 3 is a detailed view of a portion of elongated clip 20 better illustrating U-shaped attaching member 70 and the other above described features. In addition to better illustrating slot 72, hole 76, slot 78, hole 80, and slot 82, FIG. 3 illustrates bores 90 which extend from tops 92 of both first member 22 and second member 26 into slot 72 and slot 82 respectively. Exposed areas 94 of U-shaped attaching member 70 between first member 22 and center member 24, and between center member 24 and second member 26 are also shown. In one embodiment, bores 90 and exposed areas 94 are utilized for attachment of hair segments 40, or alternatively hair bundles, to elongated clip 20.

Figure 4:
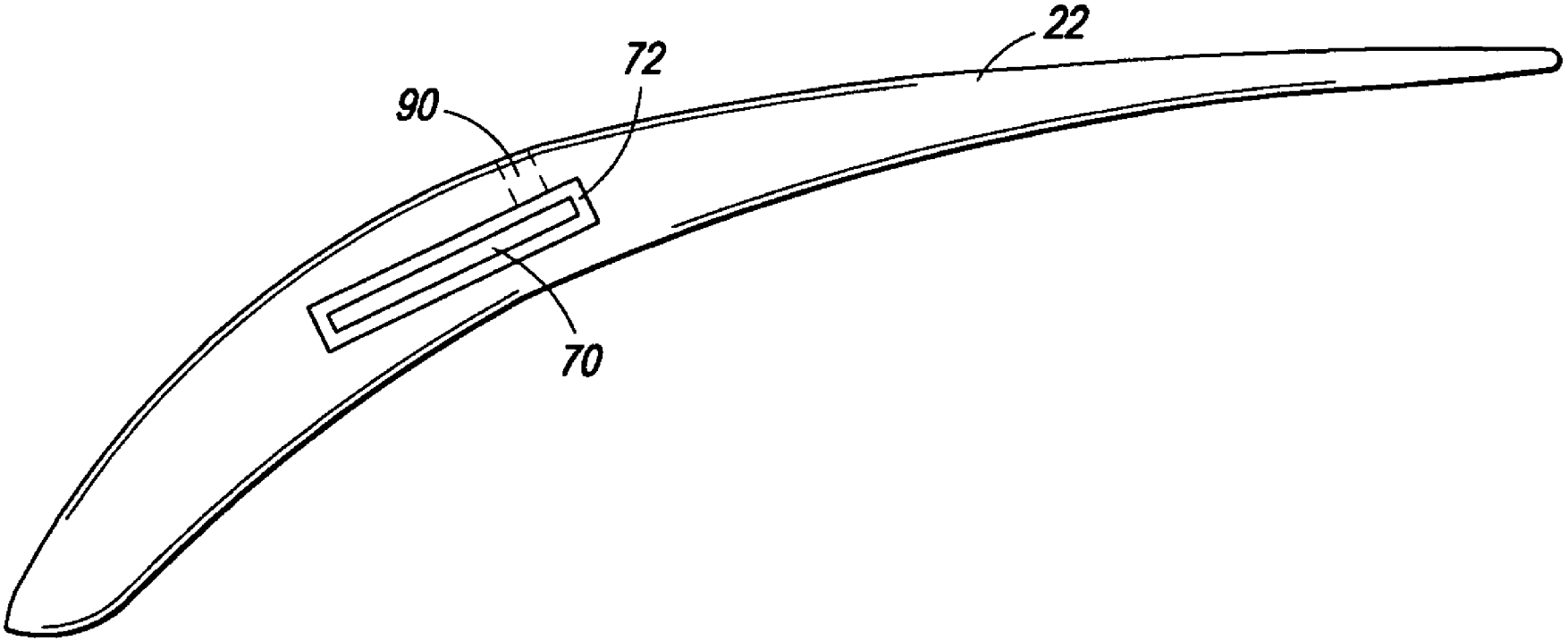
FIG. 4 is a side view of one portion of the elongated clip of FIG. 2.

FIG. 4 is a side view of first member 22 illustrating slot 72 and a side of U-shaped attaching member 70 within slot 72. Bore 90 is also illustrated in hidden view. While in the various views, elongated clip 20 is illustrated as having three individual portions (e.g., first member 22, center member 24, and second member 26), embodiments which incorporate only first member 22 and second member 26 or more than one center member 24 are contemplated and can be fabricated essentially in the same fashion as the illustrated embodiments. As shown, first member 22 has a curved or arced shape (as do center member 24 and second member 26) which roughly conforms to the shape of a user's head.

Figure 5:
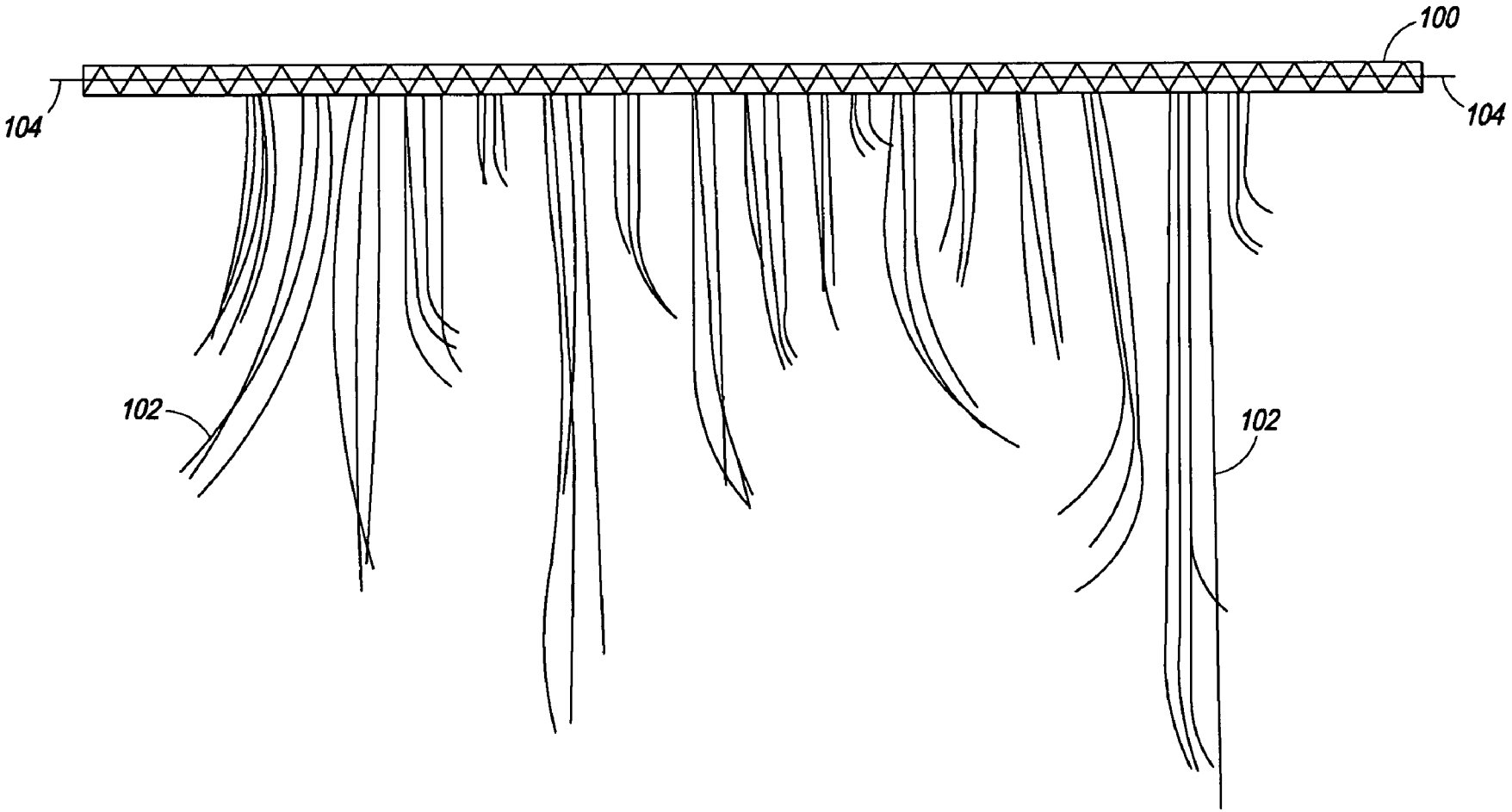
FIG. 5 is a view of hair segments attached to a hair attachment member.

FIG. 5 is an illustration of a hair attachment member 100 having a plurality of hair bundles 102 attached thereto. Hair attachment member 100 is substantially similar to hair attachment member 50 (shown in FIG. 1). In one embodiment, hair attachment member 100 has a narrow ribbon shape and hair bundles 102 are stitched thereto. In another embodiment (not shown) individual hair segments 40 (shown in FIG. 1) are attached to hair attachment member 100 by stitching or by another attachment method. In a specific embodiment, hair attachment member 100 includes end strings 104 which are utilized for attaching hair attachment member 100 to elongated clip 20 utilizing bores 90 and exposed areas 94 of U-shaped attaching member 70 through tying or other attachment means. In still another embodiment, hair attachment member 100 consists of a plurality of woven strings or thread and hair segments 40 and/or hair bundles 102 are inserted into hair attachment member 100 as it is being woven as a method of attachment, with portions of hair attachment member 100 still being utilized to attach to elongated clip 20. In such an embodiment, rather than only end strings being utilized for attachment to elongated clip 20, other portions of hair attachment member 100 may be utilized for attachment to elongated clip 20.

As illustrated in FIGS. 1 and 5, hair segments 40 and hair bundles 102 each have an individual length and style to provide various configurations to hair accessory 10 to supplement a user's natural hair. In one embodiment, hair bundles 102 include about five to about 500 individual hair segments per bundle. In another embodiment, hair segments 40 and/or hair bundles 102 are attached to hair attachment member 100 from about five to about 500 per inch along hair attachment member 100.

In one embodiment, hair segments 40, and thus hair bundles 102, are synthetic hair fabricated from one of a polymer fiber such as modacrylic, a combination of a modacrylic fiber and PVC (Poly vinyl chloride) fiber, or a polymer fiber other than modacrylic, such as, for example, acrylic. In another embodiment, hair segments 40 and hair bundles 102 are natural hair. In yet another embodiment, hair segments 40 and hair bundles 102 include both synthetic hair and natural hair.

In one embodiment, various lengths and styles (e.g., an amount of curl) of hair bundles 102 are attached to hair attachment member 100. In an alternative embodiment, the lengths and styles of hair bundles 102 attached to hair attachment member 100 are all the same.

In other alternative embodiments, hair segments 40 and/or hair bundles 102 are attached to hair attachment member 100 by methods other than stitching or weaving, including, but not limited to adhesive, pins, and/or clips. Alternatively, any other method of attachment of hair segments 40 and/or hair bundles 102 to hair attachment member 100 may be utilized. In another specific embodiment, hair bundles are attached to loop members (not shown) utilizing any of the above described attachment methods and a hair attachment member no having hair attached directly thereto is strung through the loops and then attached to elongated clip 20 utilizing any of the above described methods.

The user can utilize hair accessory 10 to supplement the user's natural hair to provide various hair styles, some of which may not be attainable, or desirable in appearance, without hair accessory 10. While hair accessory 10 is described as being attachable to the user's natural hair, hair accessory 10 can also be attached to a wig or other such supplemental hair accessory worn by the user. Also, while hair accessory 10 may be contemplated as having a single color of hair segments 40 (and/or hair bundles 102) for the entire hair accessory, different embodiments of hair accessory 10 may have different colors and lengths between hair bundles 102, and/or different colors and lengths for the individual hair segments 40 utilized in hair accessory 10. Since hair accessory 10 is removable, hair accessory 10 may be applied and removed at the leisure of the user.

While the invention has been described in terms of various specific embodiments, those skilled in the art will recognize that the invention can be practiced with modification within the spirit and scope of the claims.

What is claimed is:

1. A hair accessory comprising:

an elongated clip comprising at least two members; each said member comprising a user grasping portion, a hair engaging portion, and a transition portion therebetween; each respective grasping portion, hair engaging portion, and transition portion collectively forming a continuous line having a curved shape to complement a contour of a user's head; said hair engaging portions of said at least two members are configured to be adjacent one another along a longitudinal axis for substantially their entire length; and a plurality of hair segments attached to said elongated clip between said user grasping portion and said hair engaging portion;

wherein said elongated clip comprises an attaching member attaching and positioning said at least two members substantially parallel to one another, said attaching member having a spring like quality providing a force configured to cause said hair engaging portions of said at least two members to move towards one another;

wherein said elongated clip comprises at least one center member between, and substantially adjacent to said at least two members, said at least two members each comprising a protrusion extending therefrom, said center member configured with a plurality of slots formed therein, said protrusions configured to engage said slots.

2. A hair accessory according to claim 1 wherein said at least two members are fabricated from at least one of wood, metal, and plastic.

3. A hair accessory according to claim 1 wherein said plurality of hair segments comprises hair segments grouped in hair bundles.

4. A hair accessory according to claim 3 wherein said hair bundles comprise about five to about 500 said hair segments per bundle.

5. A hair accessory according to claim 1 wherein said plurality of hair segments comprises at least one of a differing hair color, hair length, and hair style.

6. A hair accessory according to claim 1 wherein said hair segments comprise synthetic hair fabricated from at least one of a modacrylic fiber, a PVC (poly vinyl chloride) fiber, and an acrylic fiber.

7. A hair accessory according to claim 1 wherein said hair segments comprise at least one of synthetic hair and natural hair.

8. A hair accessory according to claim 1 further comprising a hair attachment member, said hair accessory comprising about five to about 500 said hair segments attached per inch along said hair attachment member.

9. A hair accessory according to claim 8 wherein said hair segments are attached to said hair attachment member by at least one of stitching, tying, weaving, adhesive, pins, and clips.

10. A hair accessory according to claim 1 wherein:

said center member includes opposed undulating surfaces; and said hair engaging portions of said at least two members respectively include an undulating surface selectively adjacent a respective said center member undulating surface.

11. A hair accessory according to claim 1 wherein said at least two members each comprise a bore formed therein, said hair accessory further comprising a hair attachment member, said hair segments attached to said hair attachment member, said hair attachment member attached to said elongated clip utilizing said bores in said at least two members and an exposed area of said attaching member between said members.

12. A hair accessory according to claim 1 further comprising a hair attachment member, said hair segments attached to said hair attachment member, said hair attachment member attached to said elongated clip.

13. A hair accessory according to claim 12 wherein said hair attachment member is woven, said plurality of hair segments attached to said hair attachment member during the weaving of said hair attachment member.

14. A hair accessory according to claim 1, said hair accessory further comprising a hair attachment member, said hair segments attached to said hair attachment member, said hair attachment member attached to said elongated clip utilizing an exposed area of said attaching member between said at least two members.

15. A hair accessory comprising:

an elongated clip comprising at least two members; each said member comprising a user grasping portion, a hair engaging portion, and a transition portion therebetween; each respective grasping portion, hair engaging portion, and transition portion collectively forming a continuous line having a curved shape to complement a contour of a user's head; said hair engaging portions of said at least two members are configured to be adjacent one another along a longitudinal axis for substantially their entire length; and a plurality of hair segments attached to said elongated clip between said user grasping portion and said hair engaging portion;

wherein said elongated clip comprises an attaching member attaching and positioning said at least two members substantially parallel to one another, said attaching member having a spring like quality providing a force configured to cause said hair engaging portions of said at least two members to move towards one another;

wherein a center member is between and substantially adjacent said at least two members;

wherein said center member includes a user grasping portion adjacent said user grasping portions of said at least two members; and wherein said center member comprises a slot formed therein at said user grasping portion, said attaching member configured to be seated within said slot.

16. A hair accessory comprising:

an elongated clip comprising at least two members; each said member comprising a user grasping portion, a hair engaging portion, and a transition portion therebetween; each respective grasping portion, hair engaging portion, and transition portion collectively forming a continuous line having a curved shape to complement a contour of a user's head; said hair engaging portions of said at least two members are configured to be adjacent one another along a longitudinal axis for substantially their entire length; and a plurality of hair segments attached to said elongated clip between said user grasping portion and said hair engaging portion;

wherein said elongated clip comprises an attaching member attaching and positioning said at least two members substantially parallel to one another, said attaching member having a spring like quality providing a force configured to cause said hair engaging portions of said at least two members to move towards one another; and wherein said at least two members comprise slots formed therein and a hole extending from said slot, said attaching member being U-shaped, said attaching member extending from said slot in a first of said at least two members, through said hole in the first of said at least two members, through said hole in a second of said at least two members and into said slot in the second of said at least two members.

17. A method of fabricating a hair accessory including an elongated clip with at least two members; each said member having at least a user grasping portion, a hair engaging portion, and a transition portion therebetween; each respective grasping portion, hair engaging portion, and transition portion collectively forming a continuous line having a curved shape to complement a contour of a user's head; the hair engaging portions configured to be adjacent one another along a longitudinal axis for substantially their entire length; the hair accessory also including a plurality of hair segments; said method comprising:

configuring the elongated clip such that a pressure exerted at the user grasping portion of the members causes the hair engaging portion to spread apart; and attaching the plurality of hair segments to the elongated clip between the user grasping portion and the hair engaging portion;

wherein said step of configuring includes:

defining a hole in each said member; and installing an attaching member which extends through the respective hole defined in each said member and exerts a force configured to cause the hair engaging portions of the members to come into contact with one another.

18. A method according to claim 17 wherein attaching the plurality of hair segments comprises:

attaching the plurality of hair segments to a hair attachment member; and attaching the hair attachment member to the elongated clip.

19. A method according to claim 18 wherein attaching the plurality of hair segments to a hair attachment member comprises attaching bundles of hair segments each bundle including about five to about 500 hair segments to the hair attachment member.

20. A method according to claim 18 wherein attaching the plurality of hair segments to a hair attachment member comprises at least one of comprises stitching, weaving, pinning, gluing and clipping the hair segments to the hair attachment member.

21. A method according to claim 17 further comprising:

configuring the members with one or more bores therethrough; and attaching the hair attachment member to the elongated clip utilizing the bores and exposed areas of the attaching member between the members of the elongated clip.

* * * * *